United States Patent [19]

Hutter

[11] 4,222,489

[45] Sep. 16, 1980

[54] CLAMPING DEVICES

[76] Inventor: Hans-Georg Hutter, Beckgasse 46, Vienna, Austria, A-1130

[21] Appl. No.: 826,516

[22] Filed: Aug. 22, 1977

[51] Int. Cl.[2] ..... A47F 7/16

[52] U.S. Cl. ..... 211/45; 24/67 R; 211/DIG. 1; 248/316 R

[58] Field of Search ..... 24/67 R, 201 B, 73 MS, 24/81 B, 243 R; 211/DIG. 1, 44, 45; 248/206 A, 467, 316 R

[56] References Cited

U.S. PATENT DOCUMENTS

| | | | |
|---|---|---|---|
| 2,448,611 | 9/1948 | Martin | 24/201 B |
| 3,468,576 | 9/1969 | Beyer et al. | 24/201 B |

FOREIGN PATENT DOCUMENTS

| | | | |
|---|---|---|---|
| 217899 | 3/1961 | Austria | 24/67 R |

*Primary Examiner*—Kenneth Dorner
*Attorney, Agent, or Firm*—J. Harold Nissen

[57] ABSTRACT

A clamping device for gripping a blade or leaf of material and adapted to be operated with one hand. The clamping device includes two opposed walls carrying magnetic elements to lock the walls together as a result of magnetic attraction and to separate the walls in response to magnetic repulsion therebetween. A third wall pivotally connects the first two walls to permit pivotal and parallel movement of the first two walls with respect to each other.

10 Claims, 10 Drawing Figures a
b
c
1
2
3
4
4'
5
10
10'
12

1'
5
10
10'
3
1
6'

1'
5
10'
3
4
8
1
10
12
6
7

CLAMPING DEVICES

BACKGROUND OF THE INVENTION

This invention relates to clamping devices. More particularly, the invention is concerned with clamping devices to clamp blade-shaped materials such as paper or leaf-like materials.

Blade-shaped materials are understood to specifically include note pad slips, cards, travel- and parking lot tickets, drawings, data sheets and the like, which are easily accessible for instantaneous use or to collect and file them in folders.

To clamp such blade-shaped materials numerous devices of various types are already known, such as spring loaded clamps, eccentric clamps or clamps with moving, e.g. weight affected components, wedges or the like. Mechanically effective clamps as these have various drawbacks. This is particularly so when it is necessary to actuate them as a considerable skill is required, as well as the necessity to use both hands. The heretofore known clamping devices must be opened and/or kept open with one hand, and the other hand must be used to insert or remove the blade-shaped material.

The aforementioned disadvantage also applies to a well-known type of device (known from the Austrain Pat. No. DT-OS 2,245,760), which is equipped with or contains two strip-like sections of magnetic material which are mutually parallel-arranged on a flexible support and specifically provided for loose-leaf type of pages, particularly for document collators. This conventionally known clamping device requires a special liftup mechanism, a handhold or the like which is adapted to be opened by lifting off one magnetic strip from the other so as to overcome the magnetic adhesion, and move the magnets to a position so that the clamping device can pickup blade-shaped material or have such material removed therefrom.

The repeated opening and closing of this device because of the manner in which the forces are applied diminishes the effectiveness of the magnet and therefore the effective working life of the clamping device. Also known is the use of small, loosely arranged magnets capable of securing blade-shaped material to any given magnetic and/or magnetizable support. Such small magnets, however, as known from experiences are easily lost, and they are only particularly usable if a suitable base is available.

It is therefore an object of the invention to provide a clamping device which can be used and operated with one hand.

A further object of the invention is to provide a simple and easily operable clamping device which can be attached to the dashboard of an automobile, particularly to maintain the clamping device within the view of the driver, and only require one hand for operation.

Another object of the invention is to provide a single hand operated clamping device which can be readily attached to a telephone, musical instrument, mathematical calculator or the like which requires the other hand for operation.

SUMMARY OF THE INVENTION

According to a key characteristic of the invention, this problem is solved with a device of the initially described type in which both strips thereof are equipped with at least two, preferably three, longitudinally adjacent-set, variously polarized magnetic regions. Further provision is made to selectively move the magnetic regions either into a clamping position in which both adhesively face each other with unlike-mutually attracting poles, or into a release-and/or pick up position in which they repulsively face each other with like poles.

This development according to the invention allows the user with the same hand to set the clamping device into its opened position and simultaneously to insert or remove one sheet or simultaneously to insert or remove several sheets.

In principle, according to the invention, both strips can be mechanical-movably interconnected in any given way, e.g. by means of two or several cross bands, cords, joints, rings or the like. According to a preferred embodiment of the invention both strips, are arranged on a common flexible support and face other as a result of a lengthwise folding of this support and are mutually movable, particularly in an oblique way.

In this case, the flexible support not only forms a carrier for both strips, but it also has a closed back covering both strips. Moreover, the carrier can be extended as far as is required over a stack of sheets held by the strips to cover the stack on one or both sides, much like a book or batch folder. In this version, the clamping device according to the invention is also suitable to design batch assembly folders, collators or similar office auxiliary items.

To safely handle a device according to the invention, it is suggested that both strips be arranged on the support with applicably equal boundary regions adjacently positioned at a regional spacing. Such regional spacing should approximately correspond to double the thickness of the polarized magnetic material carrying strip plus the distance between the centers of different polarized magnetic regions. Then, with the folding of the support which is at opposite positions from each other, the strips are movable either into a clamping position where they face each other and adhesively cooperate with each to clamp a blade-shaped material at a mutually shifted center distance or into a release position where they face each other congruently, but at a distance from each other. A comparatively minor oblique shift of strips around above center distance suffices then to remove or produce the mutual adhesion effect of the strips.

Reinforcements can be effectively attached between both strips on the common flexible support, so that the reinforcement runs along the folding edges of this support. It is also advisable to manufacture both strips from a flexible material to take into consideration any required adjustment due to an uneven support surface.

The invention permits the user to use only one and the same hand to set the device from the clamp-position to the open position by a simple cross movement of the magnetic strip and at the same time to add or remove one or more pages. The clamping force can be regulated by the construction of the magnetic material, the field-force of the magnets as well as by varying the width or number of strips. By selection of the required opening extent necessary, the amount of movement necessary for the polarized magnetic material can be determined, and one can define the point of time when the device should be opened, how long it should remain open by choice or necessity. Finally, longevity of the magnets is comparatively greater as the loosening of the magnets from each other does not depend on a tearing away but on crossmovement of the strip and the magnets carried thereby in relation to each other does occur.

Both magnetic strips can be mechanically joined with each other in any desired manner by means, for example, with two or more cross bands, cords, joints, rings, or other suitable means. The wall portions carrying the strips can be joined by a partially flexible or pleated intermediate wall. The strip carrying wall can be reinforced with a stiffened support and intermediate wall therebetween of this support may be partially stiffened so that the strip walls are movable in relation to each other or crosswise.

Other objects, advantages and the nature of the invention will become readily apparent from the drawings which illustrate various embodiments of the invention.

DESCRIPTION OF THE PREFERRED EMBODIMENTS

Figures 1, 2, 3, 4:
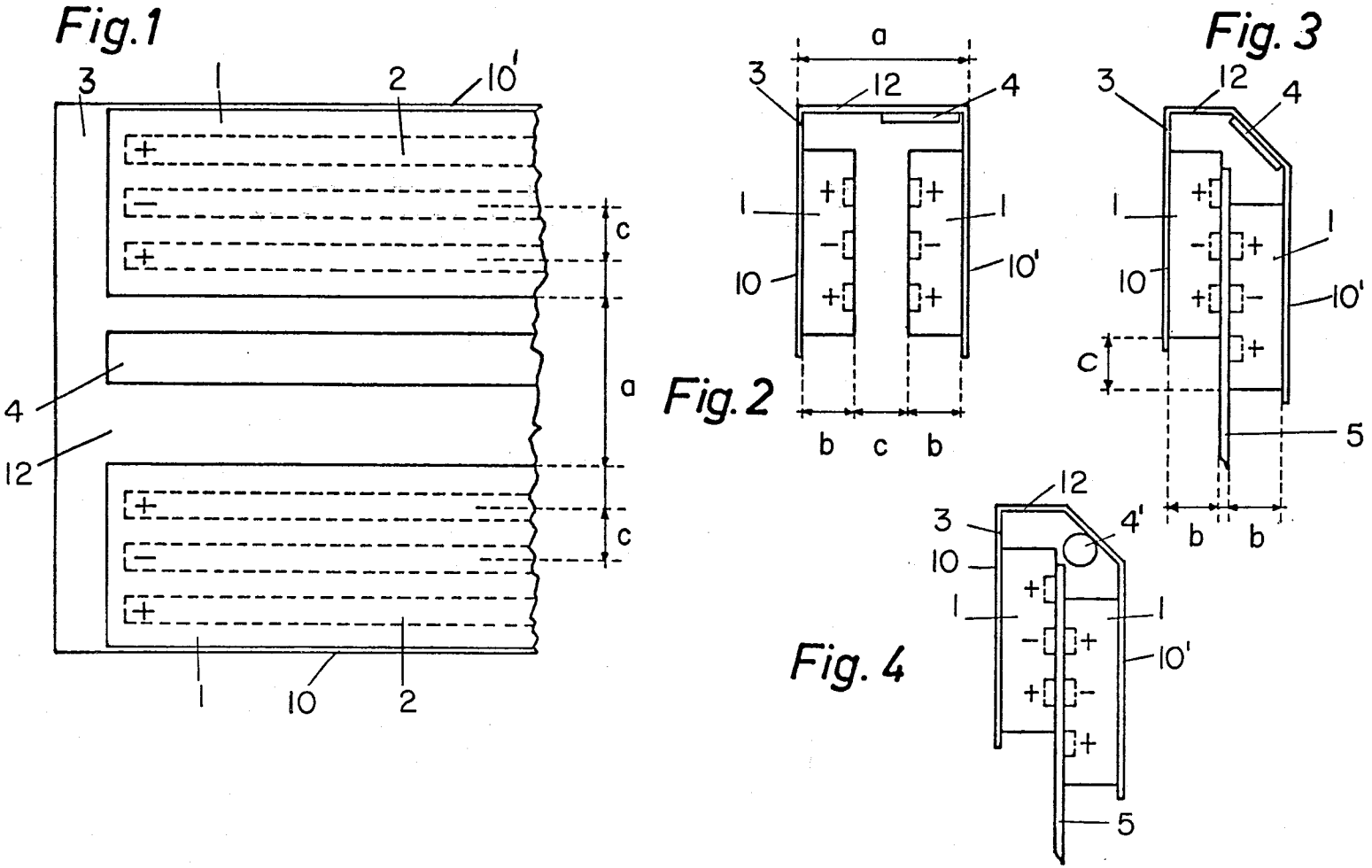
FIG. 1 is a top view of the clamping device according to the invention in its unfolded and flat condition.
FIG. 2 is a front view of the clamping device of FIG. 1 in its folded-open and pickup position.
FIG. 3 is a front view of the clamping device of FIG. 1 in its folded-closed and clamping position.
FIG. 4 is a front view of a modification of the clamping device of FIG. 1 and shown in its folded-closed and clamping position similar to that of FIG. 3.

Referring more particularly to FIGS. 1–3 of the accompanying drawings, the clamping device according to one embodiment of the invention comprises a common flexible support 3 having a pair of parallelly arranged interconnecting strips 1. Each of said strips 1 includes two or more oppositely poled magnetic elements with each strip 1 carrying a like number of magnetic elements 2 and of the same polarity.

The portions 10, 10' which carry strips 1 form two oppositely facing walls, as best seen in FIGS. 2 and 3. Walls 10, 10' are spaced from each other a distance equal to the intermediate wall 12 by a distance a in the open position of the clamping device as seen in FIG. 2. Strips 1 have a width b and are spaced from each other by a distance in the folded-open position of flexible support 3. Intermediate wall 12 has a width equal to the width b of both strips 1 and a free center space c therebetween such that the distance $a=2b+c$.

Along each strip 1, adjacent magnetic elements are of opposite polarity. In the open condition of FIG. 2, like polarized magnetic elements face each other as noted by the +and −designations, and therefore repel each other. In the closed condition of FIG. 3, oppositely polarized magnetic elements face each other and therefore are attracted to each other to hold a non-magnetic material therebetween and hold wall portions 10, 10' together in their folded-closed and clamping position.

The parallely arranged interconnecting strips 1 in conjunction with wall portions 10, 10' provide for some rigidity to the composite structure formed by strips 1 and flexible wall portions 10, 10' so that the aforesaid composite structure is less flexible than the intermediate wall 12.

To provide some rigidity to a portion of wall 12, a stiffening member such as stiffening tape 4 is provided and placed on the underside of wall 12 adjacent to wall 10' so that wall 10' will pivot at its link to wall 12, and at a portion about midway or somewhat greater than midway between walls 10, 10', wall 12 will pivot and form two wall parts pivotally linked to each other. Stiffening tape 4 imparts sufficient rigidity to part of wall 12 so that movement thereof will cause wall 10' to move axially of wall 10 and transversely thereto towards the position to align the oppositely magnetic elements 2 carried by the oppositely facing strips 1.

FIG. 4 shows a modification of the clamping device of FIGS. 1–3, with a modified stiffening member in the form of rods or pipes 4'. While only one rod 4' is shown, more than one may be provided so that wall 12 will form two wall portions which pivot relatively to each other adjacent to its midpoint. In the same manner, as in the FIGS. 1–3 embodiment, wall 10' is linked to and pivots relative to wall protion 12.

Strips 1 and magnetic elements 2 are shown somewhat enlarged and out of proportion. It is to be understood that they may be considerably thinner to provide for a suitable hand held and operated clamping device. Nevertheless, the ideal separation between the magnetic elements 2 in the open condition of FIG. 2 should be substantially the same as the separation between adjacent magnetic elements of opposite polarity on the same interconnecting strip 1, as seen in FIG. 3.

The parallel-arranged and movably interconnected strips 1 may contain, e.g. a synthetic material compounded magnetic material. These two strips 1 are shown in FIGS. 2 to 4 with an exaggerated thickness only for emphasis, and are equipped with at least two, but preferably three longitudinally adjacent, parallel, alternately polarized magnetic regions 2. Strips 1 are held to the common flexible support 3, by adhesive or welding. Strips 1 may be formed from synthetic sheeting material or flexible plastic material. Instead of planar magnetic regions 2, equally rated magnetic zones e.g., strip 1-lengthwise rows of point shaped small magnets and/or magnetic zones can be provided by imbedding them, e.g. into the synthetic material of the strip.

Magnets 2 may also be viewed as forming different polarized boundary regions 2 arranged adjacent to each other on common support 3 and at the edge distance a, which corresponds approximately to double the thickness b of strip 1 plus the center distance c between the differential polarized regions 2. Accordingly, strips 1 which face each other can be moved by their lengthwise folding either into a clamping position according to FIG. 3 and/or 4, where they adhesively face each other as a result of their mutual shift by center distance c. Or, according to FIG. 2 they can be obliquely shifted or moved into an open release-and/or pickup position where they congruently face each other so as to repel each other as a result of the equally polarized regions 2 at the approximate distance c.

The common flexible support 3 can be further lengthwise stiffened by a reinforcement arranged between both strips 1. For this purpose, reinforcing members similar to stiff reinforcement tape 4 according to the FIGS. 1 to 3 embodiment or a reinforcement rod, a tube or the like 4' of FIG. 4 can be used.

The mutual repulsing as shown by the arrows in FIG. 2 of strips 1 congruently facing each other is converted to a force close-clamping the inserted bade shaped material 5, as shown in FIG. 3, as soon as both strips are mutually vertically and obliquely shifted by wall 12 through the center distance c of polarized regions 2.

The clamping device according to the invention is attachable to any given supports by adhesive or any suitable attaching means, such as nails, pins, screws or the like, which may penetrate through strips 1. According to the adhesive force imparted by the adhesive and the type of magnetic material used, the thickness and nature of the blade shape material which is to be clamped can be varied within a wide range in other respects.

Figure 5:
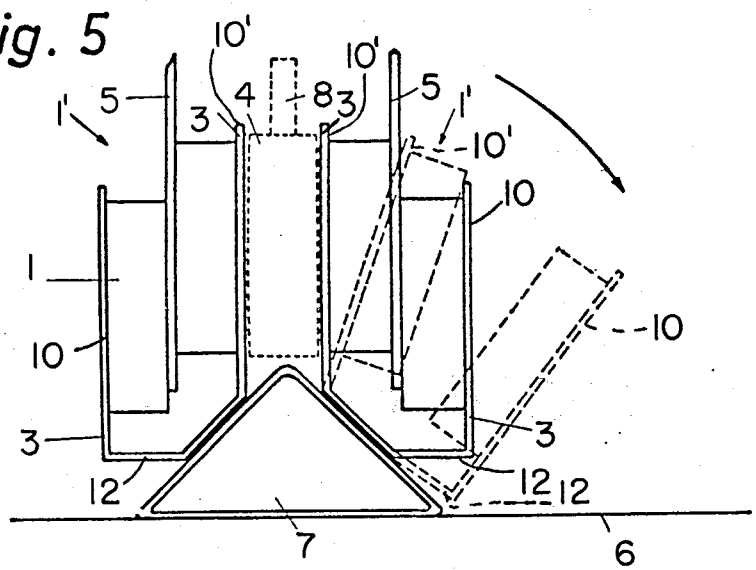
FIG. 5 is a schematic front view of a pair of the clamping devices of FIGS. 1–4 connected with a horizontally based support or holding device.

Referring to FIG. 5, the clamping devices of FIGS. 1–4 are shown connected with (or, if desired attachable to and detachable from) a common carrier or girder support 7. In FIG. 5, reference numeral 1' indicates the clamping device of FIGS. 1–4, in which like reference numerals refer to the same parts throughout, and two are shown in their closed condition with blade-like material 5 in a clamped condition. The inclined portion of the intermediate wall 12 is shown resting on inclined portions of girder 7. The two clamping devices 1' are shown spaced from each other with stiffener 4 and handle 8 positioned between wall portions 10' of each of the clamping devices. Girder 7 is placed onto a horizontal foundation or base 6 and supports the flexible support 3. Each clamping device 1' is movable from a vertical closed and clamping position as shown in full outline to an open and non-clamping position. For this purpose, handle 8 is used to swivel or pivot the clamping device 1' to the dotted outline position shown at the left to open or move wall portions 10,10' apart. In a similar manner the clamping device 1' at the left is also opened.

Handle 8 is provided which acts as a swiveling lever to facilitate the swiveling action in the direction of the arrow, and it should be noted that the strips 1 slide with respect to each other upon movement along the inclined portion of girder 7 so as to separate the magnetic elements 2 on each of the strips 1 to permit removal of blade-like material 5. Here also, when the spacing between strips 1 is equal to spacing c, the strips are no longer drawn together.

Figure 6:
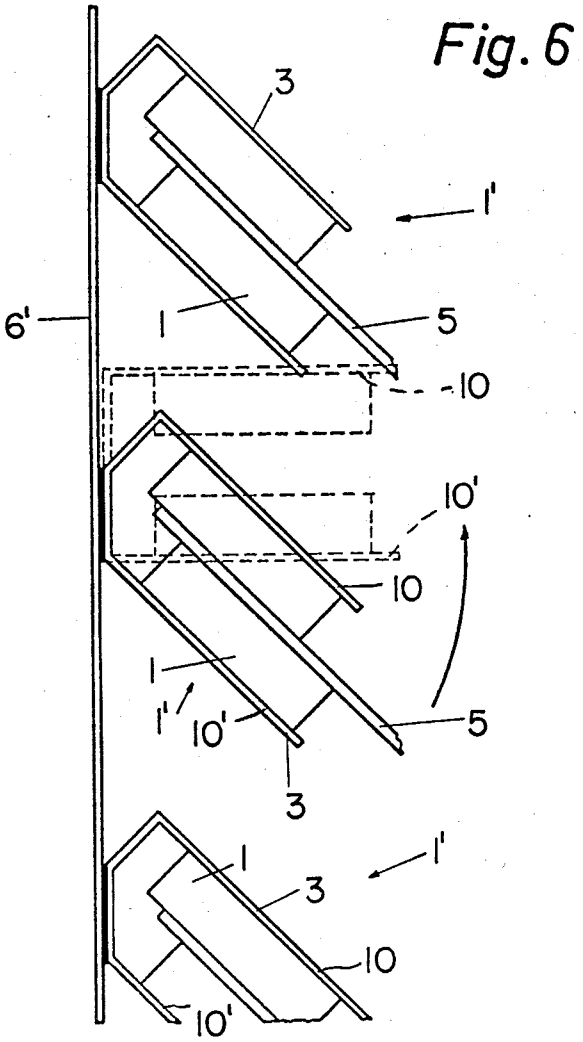
FIG. 6 is a schematic front view of a plurality of the clamping devices of FIGS. 1–4 connected with a vertical base or support.

In FIG. 6, the clamping devices 1' are attached in an arbitrary manner to a vertical support base 6' by means of intermediate wall 12.

It is preferable to couple the stiffened portion of intermediate wall 12 to the base 6', although either of wall portions 10 or 10' could equally well be connected to base 6'.

Movement of clamping devices 1' from an oblique or acute angle with base 6' in the direction of the arrow to a position in which walls 10,10' are perpendicular to base 6' forces strips 1 apart because of the magnetic repulsion of magnetic elements 2. Intermediate wall 12 swivels about its intermediate linking portion so that the portions connected with wall portions 10 and 10' are aligned with each other. Swiveling of the clamping device can be accomplished by movement of the blade-shaped material 5 in the direction of the arrow to be alotted outline positions; and, when the clamping device 1' is in the dotted outline position, material 5 may be inserted with one hand and moves strip 1 in a direction opposite to that of the arrow to the inclined and closed-clamping condition of clamping device 1'.

Figures 7, 8:
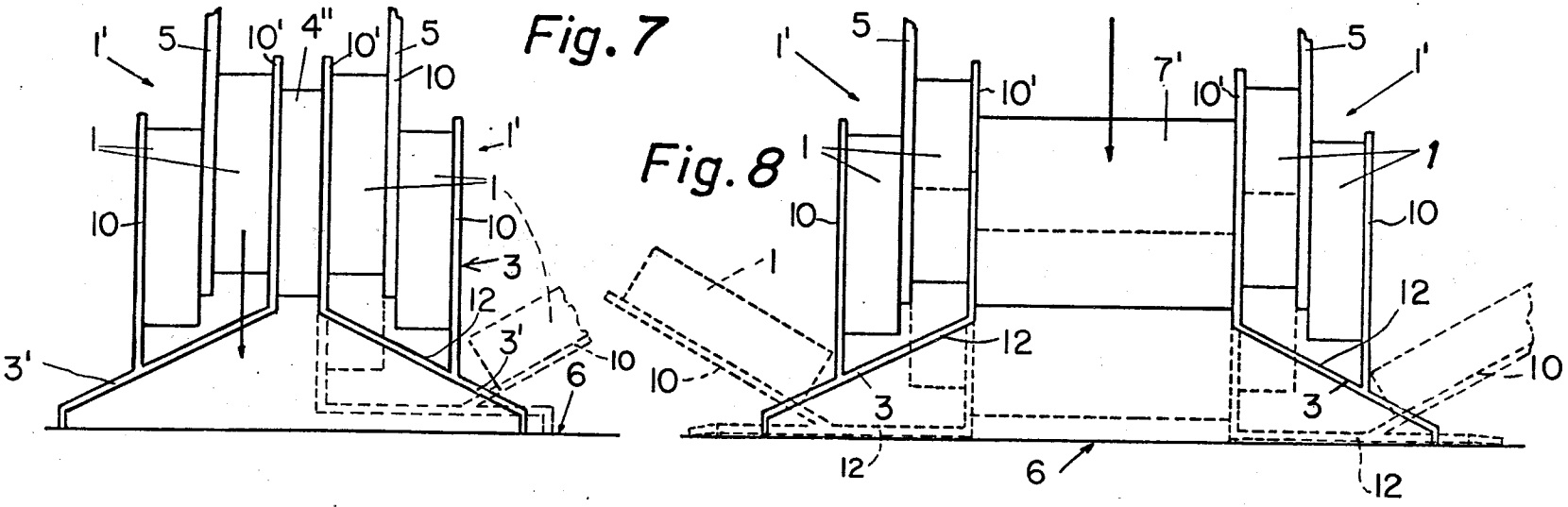
FIG. 7 is a front view of two clamping devices which are joined together with an intermediate support stiffener joining two walls of separate clamping devices.
FIG. 8 is a front view of two clamping devices which are joined together with a modified intermediate support stiffener of FIG. 7, and the modified intermediate support stiffener can perform the ancillary function of a container; and, The same elements throughout the drawings are designated with the same reference numerals and similar elements in different Figures use related reference numerals, but primed.

In FIGS. 7 and 9, and specifically in FIG. 7, two flexible clamping devices 1' are connected together with a stiffening member 4'' placed between walls 10',10'. In this modification, the clamping device 1' on the left is a mirror-image of the clamping device 1' on the right. FIG. 8 shows a modified stiffening member 17.

In the FIG. 7 embodiment, the two clamping devices 1' are interconnected with the intermediate stiffening member 4'' to form a composite unit of a pair of clamping devices, a base support 3' and an integrally connected stiffening member, and opens as illustrated in FIG. 8. The common flexible support 3 of each of the clamping devices 1' includes the base support in the form of an extension 3' of the same material as the common flexible support to support the flexible supports on a base 6 and to permit walls 10 and 10' to separate as a result of magnetic repulsion and stretching of flexible support 3. For this purpose, walls 10' are pushed down by stiffening member 4'' to the dotted outline position in the direction of the arrow. As the magnetic arrangements in this embodiment are the same as in the other embodiments, walls 10–10' are pushed apart and separated to release blade like material 5. As extension 3' is flexible, such movement thereof transverse to the direction of the arrow takes place without difficulty and with ease, so that walls 10–10' move apart sufficiently to release material 5, while the clamping devices rest on base or foundation 6. Walls 10 move horizontally away from walls 10', and they could also be made to pivot as shown in FIG. 8.

Referring more particularly to the embodiment shown in FIG. 8 of the drawings which illustrates a modification of FIG. 7, stiffening member 4'' is replaced with the stiffener which is in the form of a receptacle. Such receptacle can be used in any number of diverse articles such as, thumb-tacks, writing implements, paper clips, and in effect perform a dual function as a conventional desk caddy and a pusher to separate walls 10–10'. As illustrated very specifically in FIG. 8, walls 10 pivot at their connection with intermediate wall 12 when pusher-stiffening member 17' is moved to separate the magnetic elements carried by interconnecting strips 1. The dotted outline shows the walls in their position after pusher-stiffening member 17 is pushed in the direction of the arrow to separate the interconnecting strips 1, and cause wall 10 to separate from wall 10' and tip over or pivot at its connection with the intermediate wall 12. The dotted outline also shows the lower extent of pusher-stiffening member 17. The FIG. 8 embodiment can be placed onto a base or table top 6.

In all of the embodiments, each of the strips carries at least two oppositely poled magnetic regions or elements 2. Magnetic regions 2 can be formed in any conventional manner, so as to grip a thin leaf-like or blade-shaped material therebetween.

While there has been shown what is considered to be the preferred embodiments of the invention, it is obvious that various changes and modifications may be made without departing from the scope of the invention.

I claim:

1. A clamping device for clamping blade-shaped material and operable with one hand to remove and insert the blade-shaped material into the clamping device, comprising:

two parallely arranged strips movable relative to each other, each said parallely arranged strips including at least two oppositely poled magnetic regions, and means interconnecting said strips to move them from a first position in which said oppositely poled magnetic regions on one of said strips faces said oppositely poled magnetic regions on said other of said strips of like magnetic polarity so as to repel each other magnetically and maintain said strips in an open-material release position, to a second position in which said oppositely poled magnetic regions on one of said strips faces said oppositely poled magnetic regions on said other of said strips of unlike magnetic polarity so as to attract each other magnetically and cause said strips to move as a result of magnetic attraction into its closed and material pickup and clamping position, said interconnecting means including: a common flexible support including first and second strip carrying walls, and a third wall pivotally interconnecting and linking said first and second walls, at least one pair of said strips being carried by said first and second walls, said strips on said first and second walls being spaced from each other in their open-material release position to provide a free center space therebetween, the width of said third interconnecting wall being equal to sum of the widths of said strips and said free center space therebetween.

2. The device as set forth in claim 1, wherein:

said interconnecting means includes said third wall and a stiffener on at least a part of said third wall, said stiffener dividing said third wall into two parts linked to each other and movable relative to each other to move said first and second walls and said magnetic regions in a direction axially parallel to each other and obliquely shifted relative to each other through the free center space therebetween.

3. The device as set forth in claim 2, wherein:

said stiffener includes a stiffening rod connected with the underside of said third wall and, said first and said second walls and the part of said third wall free of said stiffener having the same flexibility, and the portion of said third wall with said stiffener being pivotable with the portion of said third wall without said stiffener and with the said strip carrying wall connected to said third wall adjacent to said stiffener.

4. The device as set forth in claim 2, wherein:

said stiffener includes a stiffening tape connected with the underside of said third wall and extending from a point substantially midway thereof to an end thereof at which one of said first and said second walls is connected for mutual pivoting between said third wall and one of said strip carrying walls and mutual pivoting of the portion of said third wall with said stiffener with the portion of said stiffener with the portion of said third wall without said stiffener, and said other strip carrying wall being attachable to a fixed surface for retention of said last-mentioned wall against movement upon movement of said first-mentioned strip carrying wall and said third wall, whereby said first-mentioned wall moves in a direction parallel and obliquely relative to said second-mentioned wall upon opening and closing of the clamping device.

5. The device as set forth in claim 2, comprising:

a vertical base support, for said clamping device; and at least two of said clamping devices being fixed to said base support along a portion of said third wall, such that pivoting of said other walls about their linkages with said third wall moves said magnetic regions on said strips from a closed blade material clamping position to an open blade release position.

6. The device as set forth in claim 1, including:

a pair of said common flexible supports each carrying at least one pair of said strips;

an extension for each of said common flexible supports to support said supports on a foundation, said extension being connected at the connection between said third walls and said first walls;

said interconnecting means including a stiffening member interconnecting said second walls to form a composite unit with said pair of flexible supports and said extensions, and said third walls connecting said first and said second walls, and at least said third wall being sufficiently elastic such that movement of said stiffening member towards said base displaces said magnetic regions from their state of mutual attraction to mutual separation and causes said first and second walls to be moved axially parallel to each other and transversely of each other to separate said first and said second walls.

7. A clamping arrangement comprising a pair of clamping devices as set forth in claim 1, including:

a pusher interconnecting said first walls of said clamping devices; and, an extension for each said clamping devices connected at the pivotal interconnection between said second and said third walls for supporting said pusher and said clamping devices as a unit on a table top; and said first walls and said pusher together with said third walls forming said interconnection means;

said pusher including a receptacle having walls connected with said first walls to form said stiffener, such that movement of said stiffener towards the table top causes said first and second walls to separate as a result of magnetic repulsion between the magnetic regions carried by said first and said second walls, said second walls pivot at their connection with said extensions and said third walls.

8. The device as set forth in claim 1, comprising:

a girder support including a base and two inclined surfaces connected with said base adapted to rest on a horizontal surface;

a pair of said two parallely arranged strips and one of said common flexible supports for each said parallely arranged strips;

each of said third walls having a portion fixed to said inclined surfaces and a portion movable relative thereto; and, said interconnecting means including said third walls and stiffener means interconnecting two of said walls connected with said third walls, said stiffener means including means to move said movable portion of said third walls at a point substantially midway between said first and said second walls to slide said strips relative to each other to move said magnetic regions from a blade clamping position to a blade release position.

9. The device as set forth in claim 1, including:

a pair of said common flexible supports each carrying at least one pair of said strips;

a base for each of said common flexible supports for support thereof; and said interconnecting means including a stiffening member interconnecting said second walls to form a composite unit with said pair of flexible supports and said base, and said third walls connecting said first and said second walls.

10. The device as set forth in claim 9, wherein said base comprises:

a vertical base support, for said clamping device; and at least two of said clamping devices being fixed to said base support along a portion of said third wall, such that pivoting of said other walls about their linkages with said third wall moves said magnetic regions on said strips from a closed blade material clamping position to an open blade release position.

* * * * *

UNITED STATES PATENT AND TRADEMARK OFFICE

CERTIFICATE OF CORRECTION

PATENT NO. : 4,222,489

DATED : September 16, 1980

INVENTOR(S) : Hans-Georg Hutter

It is certified that error appears in the above—identified patent and that said Letters Patent is hereby corrected as shown below:

Column 5, Line 12 change "bade" to --blade--

Column 6, Line 9 change "and 9," to --and 8,--

In the ABSTRACT change "10 Drawing Figures" to --8 Drawing Figures--

Signed and Sealed this

*Seventeenth* Day of *March 1981*

[SEAL]

*Attest:*

RENE D. TEGTMEYER

*Attesting Officer* *Acting Commissioner of Patents and Trademarks*